US006108950A

United States Patent [19]

Ruvang et al.

[11] Patent Number: 6,108,950

[45] Date of Patent: Aug. 29, 2000

[54] SELF-ADJUSTING TOOTH/ADAPTER CONNECTION SYSTEM FOR MATERIAL DISPLACEMENT APPARATUS

[75] Inventors: John A. Ruvang, Hickory Creek; Wesley E. Martin, Carrollton, both of Tex.

[73] Assignee: GH Hensley Industries, Inc., Dallas, Tex.

[21] Appl. No.: 09/264,533

[22] Filed: Mar. 8, 1999

[51] Int. Cl.[7] ..... E02F 9/28

[52] U.S. Cl. ..... 37/452; 37/456; 37/457

[58] Field of Search ..... 37/452, 453, 455, 37/456, 457, 458, 459; 299/109; 403/374.1, 379.4, 379.2; 411/348

[56] References Cited

U.S. PATENT DOCUMENTS

| | | | |
|---|---|---|---|
| 3,170,362 | 2/1965 | Mewse | 411/348 |
| 5,311,681 | 5/1994 | Ruvang et al. | 37/452 X |
| 5,564,206 | 10/1996 | Ruvang | 37/458 |
| 5,718,070 | 2/1998 | Ruvang | 37/459 |
| 5,784,813 | 7/1998 | Balassa | 37/455 |
| 5,931,621 | 8/1999 | Griffith et al. | 411/348 X |
| 5,937,550 | 8/1999 | Emrich | 37/456 X |
| 5,983,534 | 11/1999 | Robinson et al. | 37/452 X |
| 6,032,390 | 3/2000 | Bierwith | 37/452 X |

FOREIGN PATENT DOCUMENTS

| | | | |
|---|---|---|---|
| 698737 | 10/1953 | United Kingdom | 411/348 |

*Primary Examiner*—H. Shackelford
*Attorney, Agent, or Firm*—Konneker & Smith, P.C.

[57] ABSTRACT

An excavation tooth point longitudinally extending along an axis and having a pocket area extending inwardly through a rear end thereof is telescoped onto a nose portion of an adapter structure by inserting the nose portion into the tooth point pocket area. The inserted nose portion has a tapered side opening therein that is positioned between a corresponding pair of similarly tapered tooth side wall openings. The tooth point is removably coupled to the adapter nose using an elongated, wedge shaped connector member which is inserted, small end first, through the generally aligned tooth and adapter openings. An internal passage longitudinally extends through the large connector member end and receives an inner portion of a force exerting member which compresses a spring within the passage, the spring in turn resiliently biasing an outer portion of the force exerting member into abutment with an interior surface portion of the tooth. The compressed spring, via the force exerting member, maintains the tooth point in an axially tightened orientation on the adapter nose, and automatically tightens the tooth further onto the adapter nose in response to tooth/adapter interface wear that would otherwise cause undesirable "play" between the tooth point and the adapter nose portion. The connector may be removed by simply rotating the force exerting member to move its outer portion out of abutment with its opposing interior surface portion of the tooth.

24 Claims, 6 Drawing Sheets

FIG. 1
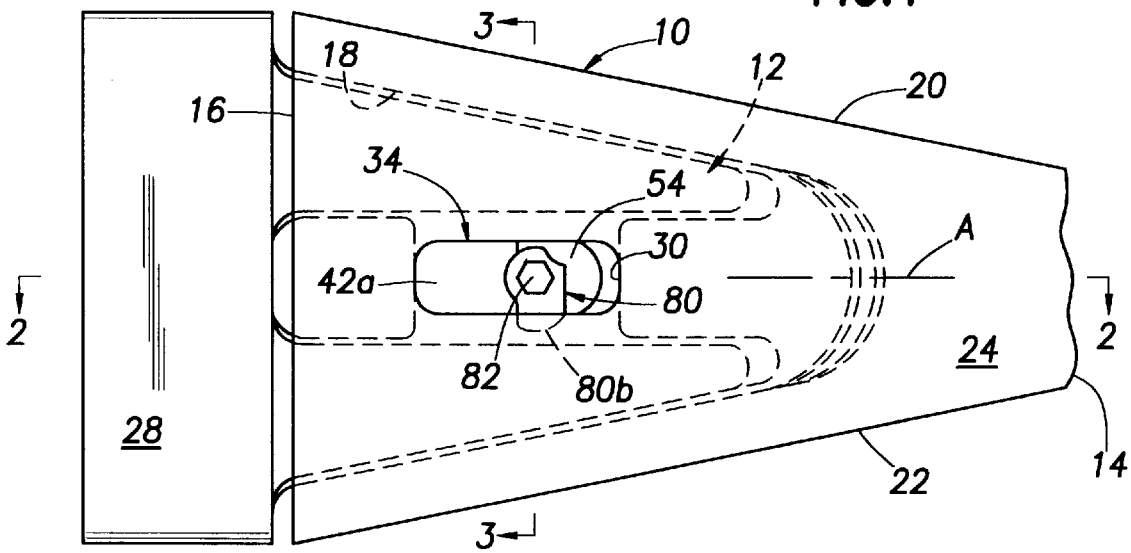
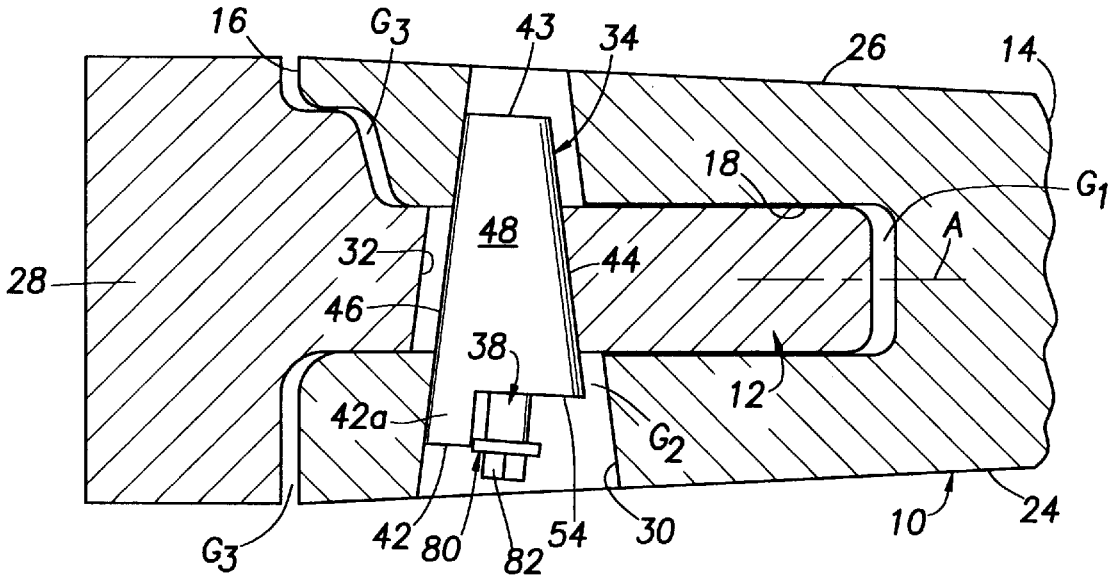
FIG. 2

FIG.3
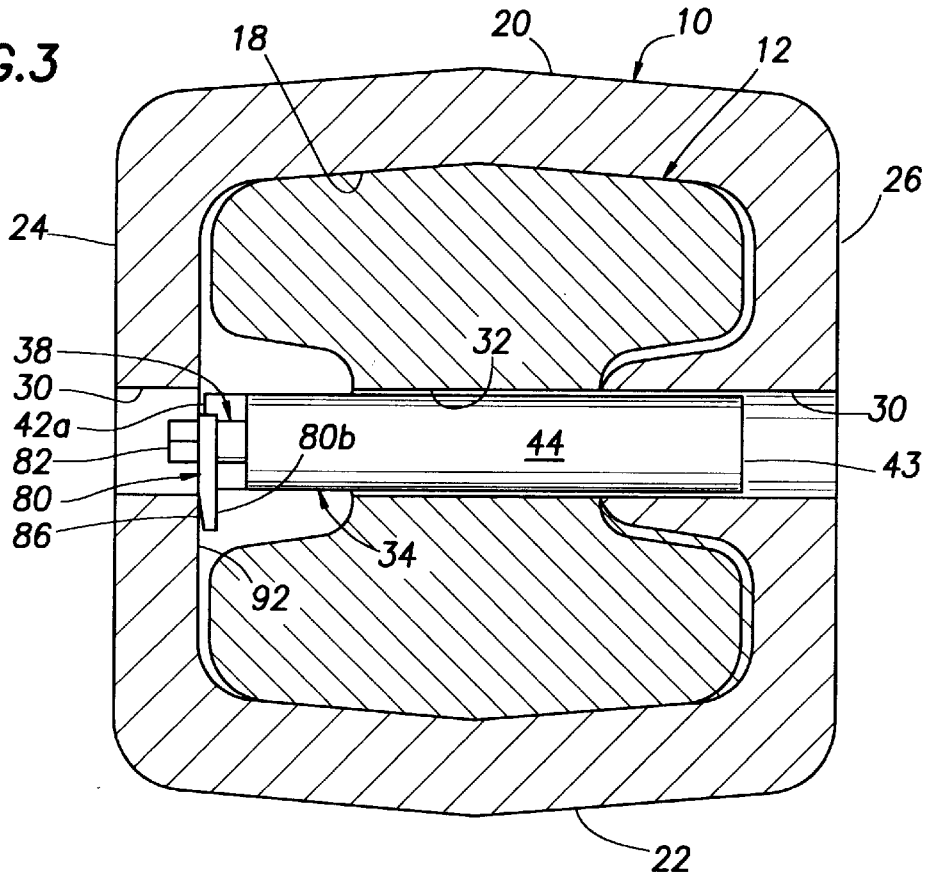
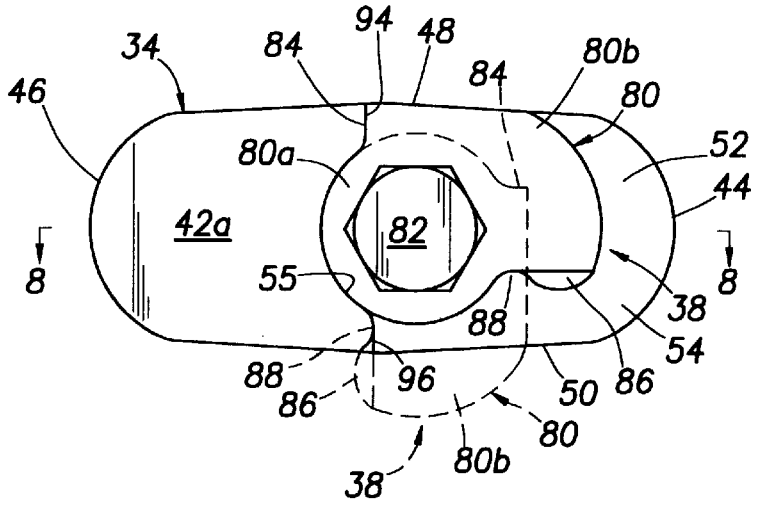
FIG.7

FIG.4
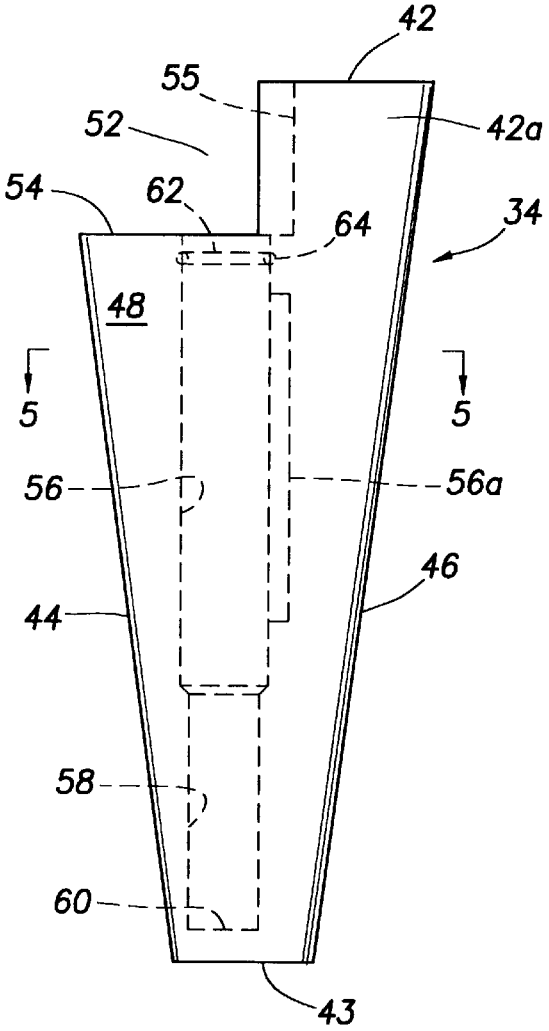
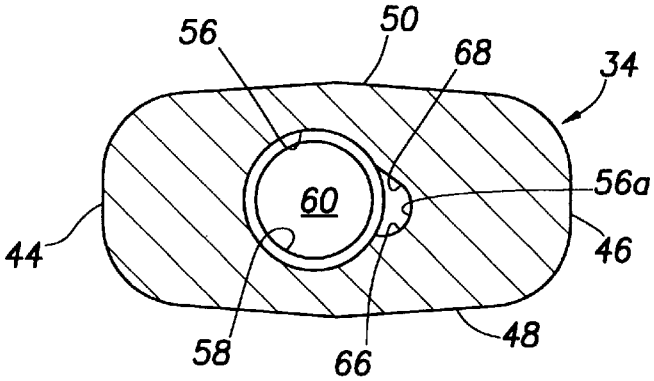
FIG.5

FIG.8
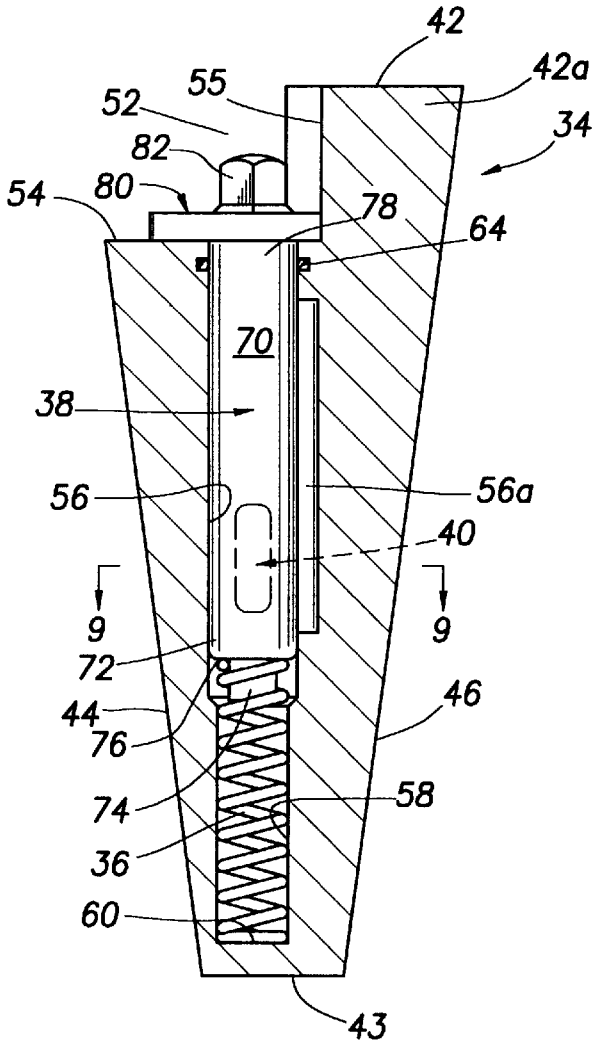
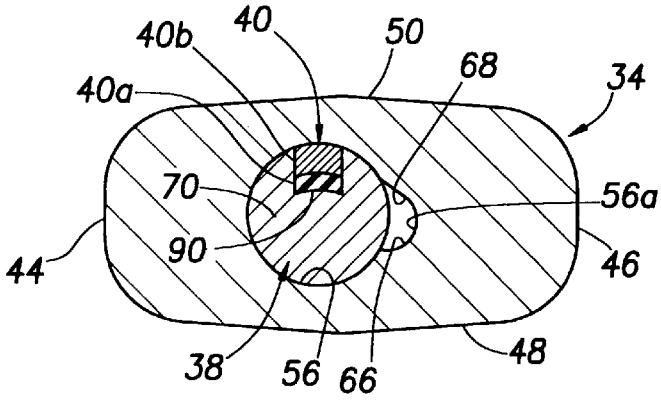
FIG.9

FIG.8A
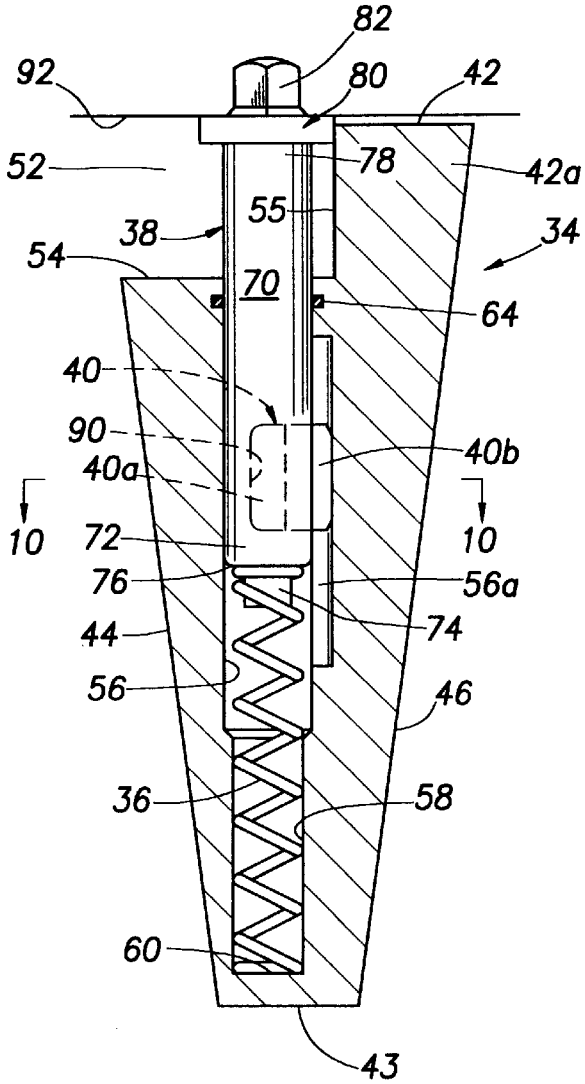
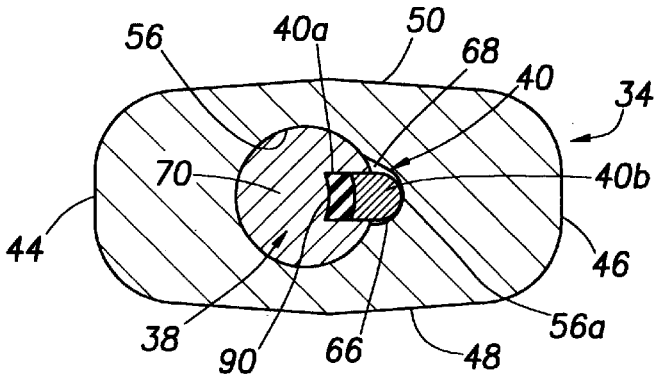
FIG.10

SELF-ADJUSTING TOOTH/ADAPTER CONNECTION SYSTEM FOR MATERIAL DISPLACEMENT APPARATUS

BACKGROUND OF THE INVENTION

The present invention generally relates to material displacement apparatus and, in a preferred embodiment thereof, more particularly relates to apparatus for releasably coupling a replaceable excavation tooth point to an associated adapter nose structure.

A variety of types of material displacement apparatus are provided with replaceable portions that are removably carried by larger base structures and come into abrasive, wearing contact with the material being displaced. For example, excavating tooth assemblies provided on digging equipment such as excavating buckets or the like typically comprise a relatively massive adapter portion which is suitably anchored to the forward bucket lip and has a reduced cross-section, forwardly projecting nose portion, and a replaceable tooth point having formed through a rear end thereof a pocket opening that releasably receives the adapter nose. To captively retain the point on the adapter nose, aligned transverse openings are formed through these interchangeable elements adjacent the rear end of the point, and a suitable connector structure is driven into and forcibly retained within the aligned openings to releasably anchor the replaceable tooth point on its associated adapter nose portion.

These connector structures adapted to be driven into the aligned tooth point and adapter nose openings typically come in two primary forms—(1) wedge and spool connector sets and (2) flex pin connectors. A wedge and spool connector set comprises a tapered spool portion which is initially placed in the aligned tooth and adapter nose openings, and a tapered wedge portion which is subsequently driven into the openings, against the spool portion, to jam the structure in place within the openings in a manner exerting high rigid retention forces on the interior opening surfaces and press the nose portion into a tight fitting engagement with the tooth socket.

Very high drive-in and knock-out forces are required to insert and later remove the steel wedge and typically require a two man effort to pound the wedge in and out—one man holding a removal tool against an end of the wedge, and the other man pounding on the removal tool with a sledge hammer. This creates a safety hazard due to the possibility of flying metal slivers and/or the second man hitting the first man instead of the removal tool with the sledge hammer. Additionally, wear between the tooth/adapter nose surface interface during excavation use of the tooth tends to loosen the initially tight fit of the wedge/spool structure within the tooth and adapter nose openings, thereby permitting the is wedge/spool structure to fall out of the openings and permitting the tooth to fall off the adapter nose.

Flex pin structures typically comprise two elongated metal members held in a spaced apart, side-by-side orientation by an elastomeric material bonded therebetween. The flex pin structure is longitudinally driven into the tooth and adapter nose openings to cause the elastomeric material to be compressed and resiliently force the metal members against the nose and tooth opening surfaces to retain the connector structure in place within the openings and resiliently press the adapter nose portion into tight fitting engagement with the interior surface of the tooth socket.

Flex pins also have their disadvantages. For example, compared to wedge/spool structures they have a substantially lower in-place retention force. Additionally, reverse loading on the tooth creates a gap in the tooth and adapter nose openings through which dirt can enter the tooth pocket and undesirably accelerate wear at the tooth/adapter nose surface interface which correspondingly reduces the connector retention force. Further, the elastomeric materials typically used in flex pin connectors are unavoidably subject to deterioration from hot, cold and acidic operating environments. Moreover, in both wedge-and-spool and flex pin connector structures relatively precise manufacturing dimensional tolerances are required in the tooth point and adapter nose portions to accommodate the installation of their associated connector structures.

A proposed solution to these problems, limitations and disadvantages typically associated with conventional wedge and spool connectors and flex pin structures is provided by the self-adjusting tooth/adapter connection system illustrated and described in U.S. Pat. No. 5,718,070 to Ruvang. In this self-adjusting connection system, a generally wedge-shaped connector member has a longitudinally extending internal passage in which a compression spring member is disposed. A generally cylindrical force exerting member with interconnected axial and circumferential side surface grooves, and a diametrically opposite pair of outwardly projecting outer end flanges, is inserted into the connecting member passage, against the resilient resistance of the spring, until the flanges engage an outer end surface of the wedge-shaped connector member.

During this insertion of the force exerting member into the connector member, opposing pin members projecting into the interior of the connector member passage slide along the longitudinal groove portions of the force exerting member. When the force exerting member is at least partially inserted into the connector member against the resilient force of the internal connector member spring, the force exerting member is rotated relative to the connector member to cause the internal connector pins to enter adjacent ones of the circumferential side surface grooves of the force exerting member and releasably lock the force exerting member in an insertion orientation relative to the wedge shaped connector member. With the force exerting member in this insertion orientation, its diametrically opposite pair of outer end flanges are received and disposed entirely within an outer end recess of the connector member disposed between relatively thin opposite corner portions of the connector member.

After the force exerting member is moved to its insertion orientation on the connector member the connector member is inserted, small end first, into the aligned tooth point and adapter openings in a manner positioning the larger connector member end inwardly of a spaced pair of interior side surface portions of the tooth point. The opposite outer end flanges are then rotated ninety degrees to swing the outer end flanges of the force exerting member outwardly beyond outer side portions of the connector member and again cause the connector member internal pins to enter the longitudinal side grooves of the force exerting member. This, in turn, causes the internal connector member spring to resiliently drive the outer end flanges outwardly against the opposing interior side surface portions of the tooth point, thereby resiliently urging the wedge shaped connector member inwardly into the aligned tooth point and adapter nose openings, causing the connector member to maintain a continual resilient tightening force on the tooth point and captively retaining the connection system within the tooth and adapter nose openings.

As the various tooth point/adapter nose interface areas experience operating wear tending to create undesirable "play" between the tooth point and adapter, the internal connector member spring simply moves the wedge shaped connector further into the aligned tooth point and adapter nose openings to automatically tighten the tooth on the adapter nose and compensate for this operating wear.

While this previously proposed self-adjusting tooth/adapter connection system is generally well suited for its intended use, and substantially reduces or eliminates many of the problems, limitations and disadvantages typically associated with conventional wedge and spool connector sets and flex pin connectors, it has several structural and operational limitations of its own.

For example, the relatively large, centrally disposed recess formed in the wide end of the wedge shaped connector member to accommodate the diametrically opposed blocking flanges of the force exerting member leaves relatively thin outwardly projecting corner portions on the wide end of the connector member that are susceptible to breakage from tooth operating loads transmitted to the connector member. Additionally, due to strength requirements, it is necessary to provide relatively thick side wall portions of the force exerting member between each adjacent pair of its circumferentially extending side wall locking grooves. Because of this, the number of axially locked "stop" positions of the force exerting member relative to the connector member is undesirably limited.

Furthermore, in order to move the force exerting member inwardly from its extended operating position to a retracted position in order to permit removal of the self-adjusting connection structure from the telescoped tooth and adapter it is necessary to push the force exerting member further into the connector member in addition to rotating the force exerting member relative to the connector member. After the tooth and adapter assembly has been in use for a period of time, dirt and other excavating residue tends to become packed between the blocking flanges and the underlying area of the connector member in a manner limiting or preventing the necessary axial inward movement of the force exerting member relative to the connector and thereby substantially interfering with the removal of the self-adjusting connection system from the telescoped tooth and adapter nose.

From the foregoing it can be seen that a need exists for an improved self-adjusting tooth/adapter connection system of the general type described above. It is to this need that the present invention is directed.

SUMMARY OF THE INVENTION

In carrying out principles of the present invention, in accordance with a preferred embodiment thereof, a specially designed material displacement tooth and adapter assembly is provided that comprises an adapter structure having a nose portion, and a replaceable hollow tooth point, representatively an excavation tooth point, the nose portion and tooth point having generally aligned connector openings therein. According to a key aspect of the invention, the tooth and adapter assembly is provided with a unique self-adjusting connection system which is received in the tooth and nose portion connector openings and is operative to automatically tighten the tooth point onto the adapter nose portion in response to interface surface area wear therebetween.

In a preferred embodiment thereof, the self-adjusting connection system includes a tapered connector member slidably received in the tooth and nose portion connector openings and having a first end, a wider second end spaced apart along an axis from the first end, and an axially extending internal passage opening outwardly through the second end. A force exertion member has an elongated body rotatably and axially movably received in the internal connector member passage and has an enlarged outer end portion. The force exerting member, in the completed tooth and adapter assembly, is in a first rotational orientation relative to the connector member with the outer end portion of the force exerting member underlying an interior surface portion of the tooth point and blocking removal of the connector from the tooth and adapter nose connector openings, the force exerting member being rotatable to a second rotational orientation permitting removal of the connector from the tooth and adapter nose connector openings.

The self-adjusting connection system, in a preferred embodiment thereof, further includes a frictional locking structure operative to (1) permit the force exerting member in its first rotational orientation to move axially relative to the connector member, and (2) frictionally lock the force exerting member to the connector member in response to movement of the force exerting member to its second rotational orientation relative to the connector member. A spring structure resiliently forces the outer end portion of the force exerting member against the interior surface portion of the tooth point.

According to an aspect of the invention, the frictional locking structure is operative to permit the force exerting member to be rotated relative to the connector member from the first rotational orientation of the force exerting member to its second rotational orientation without appreciable axial movement of the force exerting member relative to the connector member.

Illustratively, the internal connector member passage has a circular interior surface, the elongated force exerting member body has a circular side surface, and the frictional locking structure includes (1) a longitudinally extending, laterally offset passage formed in one of the circular interior surface of the internal connector member passage and the circular side surface of the elongated force exerting member body, (2) a pocket formed in the other of the circular interior surface of the internal connector member passage and the circular side surface of the elongated force exerting member body, (3) a rigid key member slidably received in the pocket for radially outward movement therethrough into the laterally offset passage when the pocket is rotationally aligned therewith, and (4) a resilient structure carried by the rigid key member and operative to resiliently resist its movement radially into the pocket.

The resilient structure is illustratively of an elastomeric material and is secured to the inner side portion of the rigid key member, with the pocket being preferably formed on the force exerting member, and the laterally offset passage being formed on the connector member. In a preferred form thereof, the laterally offset passage has a first side surface extending generally chordwise relative to the force exerting member body, and a second side surface facing the first side surface and being sloped relative thereto.

According to another aspect of the invention, the enlarged outer end portion of the force exerting member is defined by a transverse flange section having a single outwardly projecting lobe portion, the connector member has a flat, generally wedge-shaped configuration, and the second end of the connector member has a width transverse to its axis, and a single axially outwardly projecting corner portion having a thickness, measured parallel to such width, of approximately half of the width.

The asymmetrical configurations of the second connector member end and the enlarged outer force exerting member end provide the second connector member end with a substantial added degree of strength to thereby reduce the possibility that such second end will be damaged by operational tooth point loads. Moreover, the use of the frictional locking structure permits substantially infinite axial adjustment of the force exerting member in a locked relationship relative to the connector member, and further permits the force exerting member to be rotated to its second rotational orientation, in which it no longer blocks the removal of the connector member from the balance of the tooth and adapter assembly, without also axially moving the force exerting member inwardly toward the connector member.

BRIEF DESCRIPTION OF THE DRAWINGS

FIG. 1 is a partially phantomed, longitudinally foreshortened side elevational view of an excavation tooth/adapter nose assembly releasably coupled by a specially designed self-adjusting connection system embodying principles of the present invention;

FIG. 2 is a downwardly directed cross-sectional view through the assembly taken along line 2—2 of FIG. 1;

FIG. 3 is an enlarged scale partly elevational cross-sectional view through the assembly taken along line 3—3 of FIG. 1;

FIG. 4 is an enlarged scale side elevational view of a flat, wedgeshaped connector member portion of the connection system;

FIG. 5 is an enlarged scale downwardly directed cross-sectional view through the connector member taken along line 5—5 of FIG. 4;

FIG. 7 is a top end elevational view of the connection system, the solid line position of the force exerting member portion of the connection system indicating an inwardly retracted insertion/removal position thereof, and the dashed line position of the force exerting member indicating an outwardly extended operative position thereof;

FIG. 8 is a reduced scale, partly elevational cross-sectional view through the connection system, taken along line 8—8 of FIG. 7, with the force exerting member being in its inwardly retracted position;

FIG. 8A is a view similar to that in FIG. 8, but with the force exerting member being in its outwardly extended position;

FIG. 9 is an enlarged scale downwardly directed cross-sectional view through the connection system taken along line 9—9 of FIG. 8; and FIG. 10 is an enlarged scale downwardly directed cross-sectional view through the connection system taken along line 10—10 of FIG. 8A.

DETAILED DESCRIPTION

Figure 6:
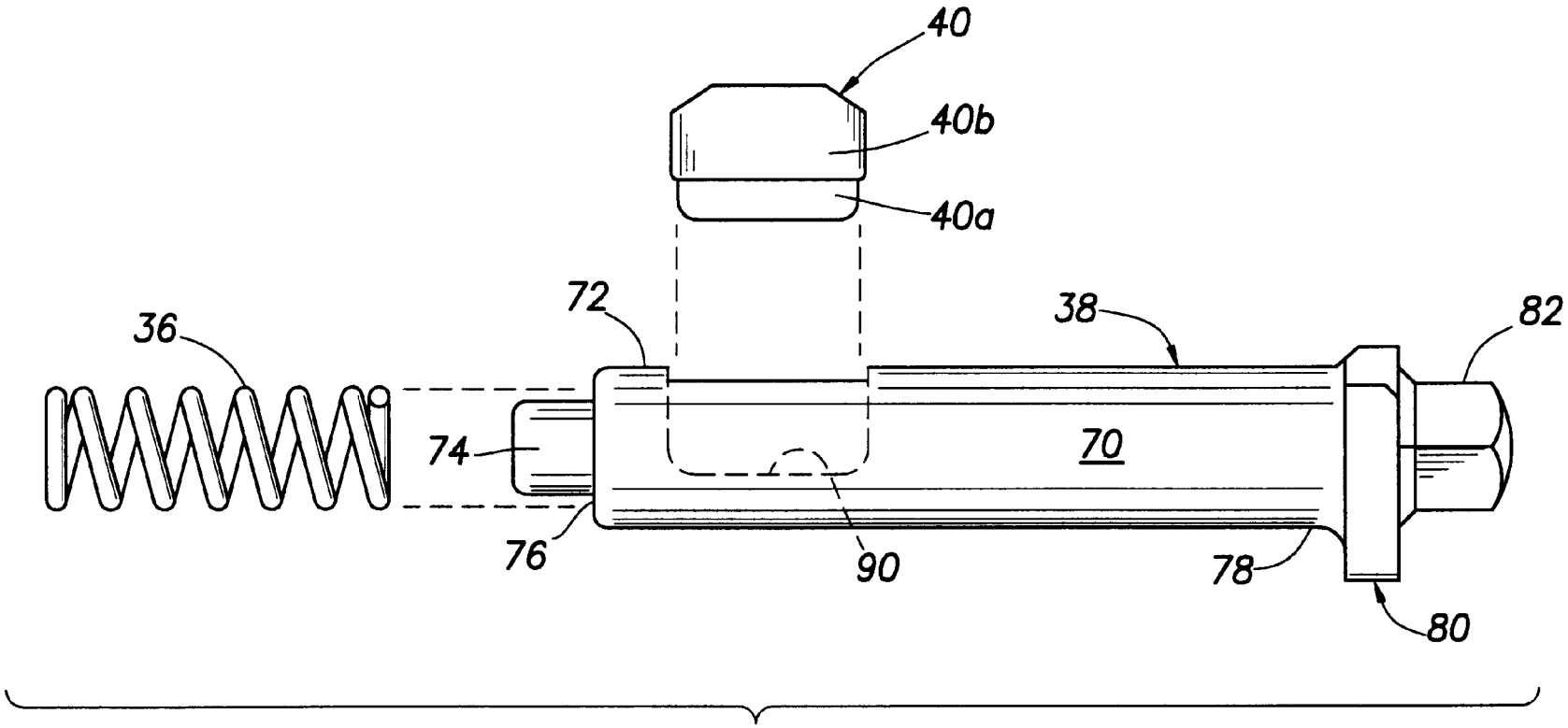
FIG. 6 is an enlarged scale exploded side elevational view of a force exerting member portion of the connection system, together with associated compression spring and resilient key member portions of the connection system.

Referring initially to FIGS. 1–3, the present invention provides, as subsequently described in detail herein, self-adjusting connection apparatus for removably joining a tooth point 10 to an associated adapter nose 12 for use in a material displacement operation such as an earth excavation task.

Removable tooth point 10 has an elongated, tapered body extending along a longitudinal axis A and having a pointed outer end 14; a wider inner end 16; a pocket area 18 extending from the inner end 16 into the interior of the tooth point 10; top and bottom sides 20,22; and left and right sides 24,26. Adapter nose 12 is configured to be complementarily and removably received in the tooth pocket area 18 and projects outwardly from a suitable support lip structure 28 such as that extending along the bottom side of an earth excavation bucket (not shown).

As illustrated in FIG. 2, the tooth point 10 has, adjacent its inner end 16, a tapered connection opening 30 extending between its opposite sides 24 and 26 and intersecting its internal pocket area 18. Opening 30 tapers inwardly toward the tooth side 26 as indicated. A similarly tapered connection opening 32 is formed in the adapter nose 12. When the adapter nose 12 is operatively received in the tooth pocket 18, the adapter nose opening 32 is communicated with opposite ends of the tooth connection opening 30 but is slightly offset therefrom toward the inner end 16 of the tooth point 10.

Referring now additionally to FIGS. 4–6, the self-adjusting connection apparatus of the present invention, in the illustrated preferred embodiment thereof, has four parts—a flat, wedge shaped connector member 34, a coiled compression spring member 36, a force exerting member 38, and a resilient key structure 40.

The flat, wedge shaped connector member 34 (see FIGS. 4 and 5) has a relatively wide first end 42, a smaller, relatively narrower second end 43, an opposite pair of sloping sides 44 and 46 extending between the first and second ends 42 and 43, and an opposite pair of generally parallel sides 48 and 50 extending between the sides 44 and 46. A corner recess 52 extends longitudinally inwardly through the first connector member end 42, has an inner end surface 54, and leaves a substantial corner portion 42*a* of the end 42, such remaining corner portion 42*a* extending across approximately one half of the left-to-right width of the upper end of the connector member 34 as viewed in FIG. 4. For purposes later described herein, the inner, horizontally facing side of the axially outwardly projecting corner portion 42*a* has an arcuate recess 55 formed in a horizontally central portion thereof.

Extending longitudinally inwardly from the inner recess end surface 54 is a circularly cross-sectioned internal passage 56 having a smaller diameter inner end portion 58 with a bottom end surface 60 positioned axially inwardly of the connector member end 43. An annular interior side surface groove 62 circumscribes an outer end portion of the passage 56 and operatively receives an elastomeric O-ring seal member 64. For purposes later described herein, a longitudinally intermediate portion 56*a* of the circularly cross-sectioned passage 56 (see FIGS. 4 and 5) is laterally enlarged toward the connector member sloping side 46 and has, along opposite sides thereof, a stop surface 66 (see FIG. 5) that extends in a generally chordwise direction relative to the passage 56, and a cam surface 68 which is ramped relative to the stop surface 66.

Turning now to FIGS. 6 and 7, the force exerting member 38 is representatively a one-piece metal structure having a cylindrical body 70 (see FIG. 6) having an inner end 72 from which a smaller diameter cylindrical portion 74 axially projects in a manner forming at its juncture with the inner end 72 an annular, axially facing ledge 76. At the outer end 78 of the body 70 is a single transverse blocking flange 80 from which a hexagonally cross-sectioned driving section 82 outwardly projects in an axial direction (see FIG. 7). As best illustrated in FIG. 7, flange 80 has a circular portion 80*a* and a laterally enlarged single lobe portion 80*b*. The laterally enlarged single lobe portion 80*b* has a stop surface 84 at its juncture with the circular portion 80*a,* a tapered outer side edge portion 86, and an arcuate side edge indentation 88 interposed between the edge portion 86 and the circular portion 80*a*.

A lateral indentation or pocket area 90 (see FIG. 6) extends inwardly through the side surface of the cylindrical force exerting member body 70 axially inwardly of the annular end ledge 76 and is sized to removably receive the resilient key structure 40. Resilient key structure has a resilient inner side portion 40*a* suitably anchored to a metal locking key member 40*b* forming the outer side portion of the key structure 40. The resilient inner side portion 40*a* is representatively of an elastomeric material, but could alternatively be a suitable mechanical spring structure or other resilient apparatus.

With reference now to FIGS. 7–10, the previously described self-adjusting connection structure is assembled by placing the compression spring 36 in the connector member passage portion 58, placing the key structure 40, elastomeric side first, into the force exerting member pocket area 90, pushing the inserted key structure 40 into the pocket area 90 to compress the elastomeric portion 40*a* and position the outer side of the metal portion 40*b* generally flush with the outer side surface of the force exerting member cylindrical body 70, and then inserting the body 70, end 72 first, into the connector member passage 56 so that the spring 36 circumscribes the reduced diameter portion 74 of the force exerting member body 70 and bears at its opposite ends against the inner passage end surface 60 and the annular ledge portion 76 of the body 70 as illustrated in FIGS. 8 and 8A.

As the body 70 is pushed into the connector member passage 56 toward the spring 36 in this manner, the key structure 40 is circumferentially aligned with the laterally enlarged passage portion 56*a* by bringing the force exerting member flange 80 to its FIG. 7 dashed line position in which the flange portion 80*b* projects outwardly beyond the side 50 of the connector member 34. This causes the outwardly projecting metal portion 40*b* of the resilient key structure 40 to enter and slide downwardly along the laterally enlarged passage portion 56*a* (see FIGS. 8A and 10) as the bottom end of the body 70 compresses the spring 36. The self-adjusting connection system is then readied for insertion into the aligned tooth and adapter openings 30,32 (see FIG. 2) by pushing the force exerting member 38 downwardly into the connector passage 56 until the bottom of the flange 80 engages the inner recess surface 54 of the connector member (see FIG. 8) at which point the key structure 40 is upwardly adjacent the bottom end of the laterally enlarged passage portion 56.

Using a suitable socket wrench (not shown) operatively engaged with the hexagonal driving portion 82 of the force exerting member 38, the force exerting member 38 is rotated in a counterclockwise direction (as viewed in FIG. 7) from its dotted line position to its solid line position in FIG. 7. This causes the metal portion 40*b* of the resilient key structure 40 to slidingly engage the passage cam surface 68 in a manner causing the cam surface 68 to drive the metal key structure portion 40*b* from its FIG. 10 orientation into the body pocket 90 as the body 70 is rotated to its FIG. 9 orientation in which the force exerting member 38 is in a position corresponding to its solid line orientation shown in FIG. 7. In this position, the compressed resilient key structure portion 40*a* drives the metal key structure portion 40*b* into forcible frictional engagement with a side surface portion of the circularly cross-sectioned passage portion 56, thereby frictionally holding the body 70 against rotational or axially outward movement relative to the connector member 34.

The connector member 34 is then inserted, end 43 first, into the aligned tooth and connector openings 30 and 32 (see FIGS. 1–3), through the portion of the opening 30 in the left side 24 of the tooth point 10, until the wider end 42 of the connector member 34 is positioned inwardly of an interior side surface portion 92 of the left side 24 of the tooth point 10 (see FIG. 3). A socket wrench is then used to rotate the force exerting member 38 relative to the inserted connector member 34 in a clockwise direction (as viewed in FIG. 7) to the dashed line position of the force exerting member 38 shown in FIG. 7. During this rotation of the force exerting member 38 relative to the connector member 34, the retracted metal portion 40*b* of the resilient key structure 40 slides along a facing circular portion of the passage 56 (see FIG. 9) toward the laterally enlarged passage portion 56*a* and then pops outwardly into the passage portion 56*a* as shown in FIG. 10.

This rotates the flange portion 80*b* outwardly beyond the connector member side 50 (see FIG. 7) and axially frees the force exerting member 38 relative to the connector member 34, thereby allowing the spring 36 to resiliently drive the force exerting member 38 outwardly from the connector member 34 to its operative position in which the now outwardly projecting flange portion 80*b* underlies and forcibly engages the interior side surface portion 92 of the tooth point 10 (see FIGS. 1, 3 and 8A) and prevents withdrawal of the connector member 34 from within the aligned tooth point and adapter nose openings 30,32. While the spring 36 is driving the force exerting member 38 outwardly from the connector member 34, the metal portion 40*b* of the resilient lock structure 40 axially slides upwardly along the laterally enlarged passage portion 56*a,* with the receipt of the metal lock structure portion 40*b* in the passage portion 56*a* maintaining the force exerting member 38 in its dashed line orientation shown in FIG. 7.

With the force exerting member 38 in this operative, outwardly extended position, the resilient force of the internal connector member spring 36 is transmitted through the force exerting member 38 to the wedge shaped connector member 34 tending to resiliently push it further into the aligned tapered tooth point and adapter nose openings 30 and 32. In turn, this maintains a resilient tightening force on the tooth point 10 directed toward the adapter lip portion 28. Thus, in response to tooth point/adapter nose interface wear the tooth is continuously and automatically tightened on the adapter nose.

It should be noted that this self-tightening action, in which driven axial movement of the tooth 10 along the nose portion 12 toward the support lip structure 28 occurs due to the automatic action of the self-adjusting connector system, is permitted (as best illustrated in FIG. 2) by the various axial gaps $G_1$ between the right or forward end of the nose portion 12 and the inner end of the tooth pocket 18; $G_2$ between the forward or right side surface of the tapered opening 30 and the connector member 34; and the gaps $G_3$ between facing interior tooth and adapter surface portions of the assembly disposed leftwardly or rearwardly of the installed connector member 34. As will be appreciated, these gaps are generally as shown in FIG. 2 when the tooth point 10 is originally installed on the adapter nose portion 12, and horizontally decrease in width as tooth/adapter nose wear occurs and the tooth point 10 is automatically tightened leftwardly onto the nose portion 12 by the action of the self-adjusting connector system just described.

Returning now to FIG. 7, to remove the connector system from the aligned tooth and connector openings 30 and 32, the force exerting member 38 is simply rotated in a counterclockwise direction away from its dashed line orientation to its solid line orientation, thereby moving the flange portion 80*b* away from its underlying relationship with the inner side surface portion 92 of the tooth 10 (see FIGS. 1 and 3) and permitting the connector member 34 to be axially removed from the aligned tooth and adapter nose openings 30,32 and thereby permit the tooth point 10 to be axially removed from the adapter nose 12. This rotation of the force exerting member 38 causes the ramped connector member passage side surface 68 (see FIG. 9) to cam the metal key structure portion 40*b* into the force exerting member pocket 90 so that when the force exerting member 38 is rotated back to its solid line FIG. 7 orientation the metal key structure portion 40*b* (see FIG. 9) is rotated into forcible engagement with the circular side surface of the connector member passage portion 56 to thereby frictionally lock the force exerting member 38 both axially and rotationally relative to the connector member.

Still referring to FIG. 7, when the force exerting member 38 is in its solid line retracted insertion/removal orientation, the circular portion 80*a* of the flange 80 is complementarily received in the arcuate recessed area 55 of the outwardly projecting corner portion 42*a* of the connector member 34, and the flange stop surface 84 is brought into abutment with a facing surface portion 94 of the connector member corner section 42*a* to thereby prevent further counterclockwise rotation of the force exerting member 38 relative to the connector member 34. When the force exerting member 38 is in its dashed line extended operative orientation, the arcuate side edge indentation 88 in the flange 80 is brought into abutment with a facing surface portion 96 of the connector member corner section 42*a,* thereby preventing further clockwise rotation of the force exerting member 38 relative to the connector member 34. At the same time, the metal portion 40*b* of the resilient key structure 40 (see FIG. 10) is rotated into engagement with the side stop surface 66 of the laterally enlarged connector member passage portion 56*a* to further block continued clockwise rotation of the force exerting member 38 relative to the connector member 34.

As the force exerting member 38 is being rotated from its FIG. 7 solid line orientation to its FIG. 7 dashed line orientation, the tapered leading side edge portion 86 of the flange section 80*b* facilitates the placement of the flange section 80*b* beneath the interior side surface portion 92 of the tooth point 10 by acting as a cam surface for engaging an edge portion of the tooth point opening 30 and slightly retracting the force exerting member 38 if the flange section 80*b* is only partially below the level of the surface 92 during such rotation of the force exerting member 38 relative to the connector member 34.

The self-adjusting connection system of the present invention (representatively comprising the previously described elements 34,36,38 and 40) provides several advantages over conventional wedge and spool sets and resilient flex pin connector structures. First, the connection system of this invention is a non-impact system—i.e., it does not have to be driven into place using a sledge hammer or the like. This, it is easier and safer to install. Second, it advantageously creates rigid resistant to undesirable movement of the tooth 10 axially toward and away from the adapter lip 28. Third, it provides for substantial increases in allowable fit/shift movement between the tooth and the adapter.

The self-adjusting connection system of the present invention also provides several structural and operational advantages over the self-adjusting connection system illustrated and described in U.S. Pat. No. 5,718,070 to Ruvang. For example, as can be seen in FIG. 7, the wider outer end of the connection system is of a unique asymmetric design, with the force exerting member 38 having only a single outwardly projecting flange blocking portion 80*b,* and the outer end 42 of the connector member 34 having only a single corner projection with a relatively massive cross-section. Because of this, damage to the outer end of the connector member 34 caused by tooth operating loads is substantially eliminated.

Additionally, due to the use of frictional locking of the force exerting member 38 within the connector member by means of the resilient key structure 40, and the absence of a finite number of circumferential locking grooves in the force exerting member, the force exerting member 38 may be axially locked in an essentially unlimited number of positions relative to the connector member 34.

Moreover, as previously described herein, the force exerting member 38 may moved from its FIG. 7 dashed line operative position to its FIG. 7 solid line release position simply by rotating the force exerting member 38 relative to the connector member 34—there is no need to also move the force exerting member 38 further into the connector member 34 to effect this rotational reorientation of the force exerting member 38. Accordingly, even if there is a solid build-up of dirt between the underside of the flange 80 and the bottom connector member recess surface 54, the connection system can be easily positioned to be removed from the aligned tooth and adapter nose openings 30,32 merely by forcibly rotating the flange 80 to its release position as described above.

As can readily be seen from the foregoing, the self-adjusting connection system of the present invention is of a simple, rugged construction, is relatively inexpensive to fabricate, and is quite simple, easy and safe to install in and remove from the tooth/adapter assembly. Additionally, the built-in wear compensation and tightening feature of the connector system is substantially greater than that of the typical flex pin connector, and permits a satisfactory installation fit between a new tooth point and either an essentially unworn adapter nose portion or a partially worn adapter nose portion.

While in the preferred embodiment of the self-adjusting connection system of the present invention, the resilient key structure 40 is carried by the force exerting member 38, and the passage portion 56*a* is formed in the connector member 34, other methods of releasably and frictionally locking the force exerting member 38 within the connector member 34, both axially and rotationally, could be alternately be utilized if desired. For example, the resilient key structure 40 could be carried by the connector member 34, and the ramped passage portion 56*a* could be formed on a longitudinal side surface portion of the force exerting member 38.

The foregoing detailed description is to be clearly understood as being given by way of illustration and example, the spirit and scope of the present invention being limited solely by the appended claims.

What is claimed is:

1. A material displacement tooth and adapter assembly comprising:

an adapter structure having a nose portion;

a replaceable hollow tooth point slidably and releasably telescoped on said adapter nose, said nose portion and said tooth point having generally aligned connector openings therein; and a self-adjusting connection system received in said tooth and nose portion connector openings and being operative to automatically tighten said tooth point onto said nose portion in response to interface surface area wear therebetween, said self-adjusting connection system including:

a tapered connector member slidably received in said tooth and nose portion connector openings and having a first end, a wider second end spaced apart along an axis from said first end, and an axially extending internal passage opening outwardly through said second end, a force exerting member having an elongated body rotatably and axially movably received in said internal passage and having an enlarged outer end portion, said force exerting member being in a first rotational orientation relative to said connector member with said outer end portion underlying an interior surface portion of said tooth point and blocking removal of said connector member from said tooth and adapter nose connector openings, said force exerting member being rotatable to a second rotational orientation permitting removal of said connector member from said tooth and adapter nose connector openings, a frictional locking structure operative to (1) permit said force exerting member in said first rotational orientation to move axially relative to said connector member, and (2) frictionally lock said force exerting member to said connector member in response to movement of said force exerting member to said second rotational orientation, said frictional locking structure being operative to permit said force exerting member to be rotated relative to said connector member from said first rotational orientation to said second rotational orientation without axial movement of said force exerting member relative to said connector member, and a spring structure resiliently forcing said outer end portion against said interior surface portion of said tooth point.

2. The material displacement tooth and adapter assembly of claim 1 wherein:

said spring structure is disposed within said internal passage and bears against an inner end portion of said force exerting member body.

3. The material displacement tooth and adapter assembly of claim 1 wherein:

said enlarged outer end portion of said force exerting member is defined by a transverse flange section having a single outwardly projecting lobe portion.

4. The material displacement tooth and adapter assembly of claim 3 wherein:

said single outwardly projecting lobe portion has a tapered outer end section.

5. The material displacement tooth and adapter assembly of claim 1 wherein:

said tooth point is a replaceable excavation tooth point.

6. A material displacement tooth and adapter assembly comprising:

an adapter structure having a nose portion;

a replaceable hollow tooth point slidably and releasably telescoped on said adapter nose, said nose portion and said tooth point having generally aligned connector openings therein; and a self-adjusting connection system received in said tooth and nose portion connector openings and being operative to automatically tighten said tooth point onto said nose portion in response to interface surface area wear therebetween, said self-adjusting connection system including:

a tapered connector member slidably received in said tooth and nose portion connector openings and having a first end, a wider second end spaced apart along an axis from said first end, and an axially extending internal passage opening outwardly through said second end, a force exerting member having an elongated body rotatably and axially movably received in said internal passage and having an enlarged outer end portion, said force exerting member being in a first rotational orientation relative to said connector member with said outer end portion underlying an interior surface portion of said tooth point and blocking removal of said connector member from said tooth and adapter nose connector openings, said force exerting member being rotatable to a second rotational orientation permitting removal of said connector member from said tooth and adapter nose connector openings, a frictional locking structure operative to (1) permit said force exerting member in said first rotational orientation to move axially relative to said connector member, and (2) frictionally lock said force exerting member to said connector member in response to movement of said force exerting member to said second rotational orientation, and a spring structure resiliently forcing said outer end portion against said interior surface portion of said tooth point, said internal connector member passage has a circular interior surface, said elongated force exerting member body has a circular side surface, and said frictional locking structure includes:

a longitudinally extending, laterally offset passage formed in one of said circular interior surface of said internal connector member passage and said circular side surface of said elongated force exerting member body, a pocket formed in the other of said circular interior surface of said internal connector member passage and said circular side surface of said elongated force exerting member body, a rigid key member slidably received in said pocket for radially outward movement therethrough into said laterally offset passage when said pocket is rotationally aligned therewith, and a resilient structure carried by said rigid key member and operative to resiliently resist its movement radially into said pocket, said internal passage having a cylindrical interior surface, said elongated force exerting member body having a cylindrical side surface, and said frictional locking structure including:

a longitudinally extending passage formed in one of said cylindrical interior surface of said internal passage and said cylindrical side surface of said elongated force exerting member body, a pocket formed in the other of said cylindrical interior surface of said internal passage and said cylindrical side surface of said elongated force exerting member body, a rigid key member slidably received in said pocket for radially outward movement therethrough into said longitudinally extending passage when said pocket is rotationally aligned with said longitudinally extending passage, and a resilient structure carried by said rigid key member and operative to resiliently resist its movement radially into said pocket.

7. The material displacement tooth and adapter assembly of claim 6 wherein:

said resilient structure is of an elastomeric material and is secured to an inner side portion of said rigid key member.

8. The material displacement tooth and adapter assembly of claim 6 wherein:

said pocket is formed on said force exerting member, and said longitudinally extending passage is formed on said connector member.

9. The material displacement tooth and adapter assembly of claim 6 wherein:

said longitudinally extending passage has a first side surface extending parallel to a chord of said cylindrical side surface of said force exerting member body, and a second side surface facing said first side surface and being sloped relative thereto.

10. A material displacement tooth and adapter assembly comprising:

an adapter structure having a nose portion;

a replaceable hollow tooth point slidably and releasably telescoped on said adapter nose, said nose portion and said tooth point having generally aligned connector openings therein; and a self-adjusting connection system received in said tooth and nose portion connector openings and being operative to automatically tighten said tooth point onto said nose portion in response to interface surface area wear therebetween, said self-adjusting connection system including:

a tapered connector member slidably received in said tooth and nose portion connector openings and having a first end, a wider second end spaced apart along an axis from said first end, and an axially extending internal passage opening outwardly through said second end, a force exerting member having an elongated body rotatably and axially movably received in said internal passage and having an enlarged outer end portion defined by a transverse flange section having a single outwardly projecting lobe portion, said force exerting member being in a first rotational orientation relative to said connector member with said outer end portion underlying an interior surface portion of said tooth point and blocking removal of said connector member from said tooth and adapter nose connector openings, said force exerting member being rotatable to a second rotational orientation permitting removal of said connector member from said tooth and adapter nose connector openings, a frictional locking structure operative to (1) permit said force exerting member in said first rotational orientation to move axially relative to said connector member, and (2) frictionally lock said force exerting member to said connector member in response to movement of said force exerting member to said second rotational orientation, a spring structure resiliently forcing said outer end portion against said interior surface portion of said tooth point, said connector member having a flat, generally wedge-shaped configuration, and said second end of said connector member having a width transverse to said axis, and a single axially outwardly projecting corner portion having a thickness, measured parallel to said width, of approximately half of said width.

11. Apparatus for use in removably coupling a replaceable material displacement tooth point to an adapter nose structure received in an internal pocket area of said tooth point, said tooth point and said nose structure having generally alignable connection openings therein, said apparatus comprising a generally wedge-shaped connector member insertable into the aligned connection openings and having:

a first end having an outer end surface;

a smaller second end longitudinally spaced apart from said first end;

first and second opposite sides extending between said first and second ends and being laterally inwardly sloped from said first and to said second end;

third and fourth generally parallel opposite sides extending between said first and second opposite sides;

a circularly cross-sectioned internal passage extending longitudinally inwardly from said outer end surface of said first end and being configured to coaxially receive a coiled compression spring member; and an elongated depression formed in the side surface of said circularly cross-sectioned internal passage, longitudinally extending parallel to said internal passage, and forming a lateral enlargement of a longitudinal portion of said internal passage, said connector member having, at said first end, a width extending between said first and second opposite sides and a single outwardly projecting corner portion having a thickness, measured parallel to said width, of approximately half of said width.

12. Apparatus for use in removably coupling a replaceable material displacement tooth point to an adapter nose structure received in an internal pocket area of said tooth point, said tooth point and said nose structure having generally alignable connection openings therein, said apparatus comprising a generally wedge-shaped connector member insertable into the aligned connection openings and having:

a first end having an outer end surface;

a smaller second end longitudinally spaced apart from said first end;

first and second opposite sides extending between said first and second ends and being laterally inwardly sloped from said first and to said second end;

third and fourth generally parallel opposite sides extending between said first and second opposite sides;

a circularly cross-sectioned internal passage extending longitudinally inwardly from said outer end surface of said first end and being configured to coaxially receive a coiled compression spring member;

an elongated depression formed in the side surface of said circularly cross-sectioned internal passage, longitudinally extending parallel to said internal passage, and forming a lateral enlargement of a longitudinal portion of said internal passage; and a coiled compression spring member coaxially received in an inner end portion of said internal passage.

13. The apparatus of claim 12 further comprising:

a force exerting member having an elongated body rotatably and axially movably received in said internal passage and being engaged and axially outwardly biased by said spring member, said force exerting member having an enlarged outer end portion, and an inner end portion having a pocket extending inwardly through a side surface thereof, said force exerting member being rotatable relative to said connector member between first and second rotational orientations in which said pocket respectively faces and is rotated out of alignment with said elongated depression, and a resilient key structure carried in said pocket and being configured to enter said elongated depression and thereby permit axial movement of said force exerting member relative to said connector member when said force exerting member is rotated to said first rotational orientation, and be pressed into said pocket in a manner frictionally locking said force exerting member to said connector member when said force exerting member is rotated to said second rotational orientation.

14. The apparatus of claim 13 wherein:

said enlarged outer end portion of said force exerting member is a laterally enlarged flange portion having a single outwardly projecting lobe configured to extend outwardly beyond one of said first and second opposite sides of said connector member when said force exerting member is in said first rotational orientation relative to said connector member, and be disposed generally within the periphery of said first end of said connector member when said force exerting member is in said second rotational orientation relative to said connector member.

15. The apparatus of claim 14 wherein:

said single outwardly projecting lobe portion has a tapered outer end section.

16. Material displacement apparatus comprising:

a replaceable tooth point having a front end, a rear end, an adapter nose pocket extending forwardly along an axis through said rear end and circumscribed by a laterally outer wall portion of said tooth point, and an aligned pair of tapered connector openings formed through opposed sections of said laterally outer wall portion;

an adapter having a forwardly projecting nose portion removably receivable in said adapter nose pocket and engageable with the interior surface thereof along an interface area having oppositely facing tapered portions, said tooth point and said adapter being relatively configured in a manner permitting rearward axial tightening movement of said tooth point relative to said nose portion in response to tooth point and adapter nose portion wear along said tapered interface area portions, said nose portion having a tapered connector opening extending transversely therethrough which is positionable between and generally alignable with said tooth point connector openings;

self-adjusting connection apparatus for releasably retaining said adapter nose portion within said adapter nose pocket and exerting a continuous, rearward axial tightening force on said tooth point so that operating wear on said opposite tapered portions of said interface area responsively creates rearward tightening movement of said tooth point along said nose portion, said self-adjusting connection apparatus including:

an elongated connector member having a first end, a smaller second end spaced apart from said first end in a first direction, and longitudinally tapered opposite first and second side surfaces extending between said first and second ends, said connector member being longitudinally insertable, second end first, in an insertion direction into the aligned tapered connector openings in said tooth point and adapter nose portion in a manner causing said tapered opposite first and second side surfaces of said connector member to complementarily and slidably engage opposing surface portions of said tapered connector openings in said tooth point and adapter nose portions, said connector member further having a longitudinally extending internal passage opening outwardly through said first end thereof, a resiliently deformable spring member insertable into said internal passage, an elongated force exerting member having (1) a first longitudinal portion slidably insertable into said internal passage, through said first end of said connector member, to resiliently deform said spring member within said internal passage and cause said spring member to exert a resilient outward force on said force exerting member, and (2) a second longitudinal portion positionable against an interior surface portion of said outer wall portion of said tooth point, with said force exerting member in a first rotational orientation relative to said connector member, in a manner blocking removal of said connector member from said aligned tooth and adapter openings and utilizing said resilient force to cause said connector member to resiliently bias said tooth point rearwardly along said nose portion, said force exerting member being rotatable relative to said connector to a second rotational orientation in which said second longitudinal portion of said force exerting member is shifted away from said interior surface portion of said outer wall portion of said tooth point to thereby permit removal of said connector from said aligned tooth and adapter openings, and cooperating frictional locking structures on said connector member and said first longitudinal portion of said force exerting member for permitting axial movement of said force exerting member relative to said connector member in response to rotation of said force exerting member to said first rotational orientation relative to said connector member, and for frictionally locking said force exerting member to said connector member in response to rotation of said force exerting member to said second rotational orientation relative to said connector member.

17. The material displacement apparatus of claim 16 wherein:

said cooperating frictional locking structures are operative to permit said force exerting member to be rotated within said connector member between said first and second rotational orientations without longitudinal movement of said force exerting member relative to said connector member.

18. The material displacement apparatus of claim 16 wherein:

said internal passage has a cylindrical interior surface, said first longitudinal portion of said force exerting member has a cylindrical side surface, and said cooperating frictional locking structures include:

a longitudinally extending passage formed in one of said cylindrical interior surface of said internal passage and said cylindrical side surface of said first longitudinal force exerting member portion, a pocket formed in the other of said cylindrical interior surface of said internal passage and said cylindrical side surface of said elongated force exerting member body, a rigid key member slidably received in said pocket for radially outward movement therethrough into said longitudinally extending passage when said pocket is rotationally aligned with said longitudinally extending passage, and a resilient structure carried by said rigid key member and operative to resiliently resist its movement radially into said pocket.

19. The material displacement apparatus of claim 18 wherein:

said resilient structure is of an elastomeric material and is secured to an inner side portion of said rigid key member.

20. The material displacement apparatus of claim 18 wherein:

said pocket is formed on said first longitudinal portion of said force exerting member, and said longitudinally extending passage is formed on said connector member.

21. The material displacement apparatus of claim 18 wherein:

with said first longitudinal portion of said force exerting member disposed within said internal connector member passage, said longitudinally extending passage has a first side surface extending parallel to a chord of said cylindrical side surface of said first portion of said longitudinal force exerting member, and a second side surface facing said first side surface and being sloped relative thereto.

22. The material displacement apparatus of claim 16 wherein:

said second longitudinal portion includes a transverse flange section having a single outwardly projecting lobe portion.

23. The material displacement apparatus of claim 22 wherein:

said single outwardly projecting lobe portion has a tapered outer end section.

24. The material displacement apparatus of claim 22 wherein:

said first end of said connector member has a width transverse to said first direction, and a single longitudinally outwardly projecting corner portion having a thickness, measured parallel to said width, of approximately half of said width.

* * * * *

UNITED STATES PATENT AND TRADEMARK OFFICE

CERTIFICATE OF CORRECTION

PATENT NO. : 6,108,950
DATED : August 29, 2000
INVENTOR(S) : John A. Ruvang and Wesley E. Martin It is certified that error appears in the above-identified patent and that said Letters Patent is hereby corrected as shown below:

Column 12,
Lines 36 through 56, delete beginning with the phrase "said internal connector" and ending with the phrase "into said pocket."

Signed and Sealed this

Fifteenth Day of January, 2002

*Attest:*

*Attesting Officer*

JAMES E. ROGAN
*Director of the United States Patent and Trademark Office*